US009340895B1

(12) United States Patent
Woo

(10) Patent No.: US 9,340,895 B1
(45) **Date of Patent: *May 17, 2016**

(54) SYSTEMS AND METHODS FOR SEPARATING COMPONENTS OF A MULTILAYER STACK OF ELECTRONIC COMPONENTS

(71) Applicant: The Boeing Company, Seal Beach, CA (US)

(72) Inventor: Robyn Lai-Wun Woo, Newport Beach, CA (US)

(73) Assignee: The Boeing Company, Chicago, IL (US)

( * ) Notice: Subject to any disclaimer, the term of this patent is extended or adjusted under 35 U.S.C. 154(b) by 401 days.

This patent is subject to a terminal disclaimer.

(21) Appl. No.: 13/929,557

(22) Filed: Jun. 27, 2013

(51) Int. Cl.
*C25F 7/00* (2006.01)
*C25F 5/00* (2006.01)

(52) U.S. Cl.
CPC .... *C25F 5/00* (2013.01); *C25F 7/00* (2013.01)

(58) Field of Classification Search
CPC ..... C25F 7/00
See application file for complete search history.

(56) References Cited

U.S. PATENT DOCUMENTS

| | | | | |
|---|---|---|---|---|
| 4,846,931 | A | 7/1989 | Gmitter et al. | |
| 4,883,561 | A | 11/1989 | Gmitter et al. | |
| 5,344,517 | A * | 9/1994 | Houlding | C25F 3/12 156/236 |
| 5,641,381 | A | 6/1997 | Bailey et al. | |
| 6,884,740 | B2 | 4/2005 | Hu et al. | |
| 7,994,419 | B2 | 8/2011 | Pan et al. | |
| 2009/0044860 | A1 | 2/2009 | Pan et al. | |
| 2010/0116784 | A1 | 5/2010 | Archer | |

OTHER PUBLICATIONS

Konagai et al, Journal of Crystal Growth 45, 277-280 (1978).
Yablanovitch et al., Appl. Phys. Lett. 51, 2222-2224 (1987).
Yablonovitch et al., Appl. Phys. Lett. 56, 2419-2421 (1990).
Lee et al., Appl. Phys. Lett. 97, 101107 (2010).
Yoon et al., Nature Lett. 465, 329-333 (May 20, 2010).

* cited by examiner

*Primary Examiner* — Evan Pert
(74) *Attorney, Agent, or Firm* — Dascenzo Intellectual Property Law, P.C.

(57) ABSTRACT

Systems and methods for separating components of a multilayer stack of electronic components are disclosed herein. The multilayer stack of electronic components may include an internal photovoltaic cell and includes a substrate, a sacrificial anode portion, a cathode portion, and an electronic assembly. The sacrificial anode portion extends between the electronic assembly and the substrate and also extends between the electronic assembly and the internal photovoltaic cell, when present. The internal photovoltaic cell, when present, extends between the sacrificial anode portion and the cathode portion. The multilayer stack may be located within an electrically conductive fluid to form an electrochemical cell, and the methods include generating a potential difference between the cathode portion and the sacrificial anode portion and electrochemically oxidizing the sacrificial anode portion to dissolve the sacrificial anode portion within the electrically conductive fluid and separate the electronic assembly from the substrate.

20 Claims, 4 Drawing Sheets

SYSTEMS AND METHODS FOR SEPARATING COMPONENTS OF A MULTILAYER STACK OF ELECTRONIC COMPONENTS

FIELD

The present disclosure is directed generally to systems and methods for separating components of a multilayer stack of electronic components, and more specifically to systems and methods that include electrochemical oxidation of a sacrificial anode, which extends between the components of the multilayer stack, to dissolve the sacrificial anode and permit separation of the components of the multilayer stack.

BACKGROUND

Electronic and/or optoelectronic devices may be fabricated on a substrate; and, under certain conditions, it may be desirable to separate the devices from the substrate subsequent to fabrication thereof. As an illustrative, non-exclusive example, it may be desirable to decrease an overall thickness and/or weight of the devices through removal of the substrate. As another illustrative, non-exclusive example, certain photovoltaic cells may be fabricated in such a manner that at least a portion of the substrate must be separated from the photovoltaic cells prior to operation thereof. This especially may be true with inverted photovoltaic cells, which may be designed to receive light from a side of the inverted photovoltaic cell that is in contact with the substrate during fabrication of the inverted photovoltaic cell. Under these conditions, separation of the photovoltaic cells from the substrate may permit additional light to contact the photovoltaic cell, thereby enabling operation and/or increasing an operational efficiency of the photovoltaic cell.

Historically, etching operations have been utilized to separate the devices from the substrate. These etching operations may utilize highly corrosive chemical solutions and rely upon a difference in etch rate, or etch selectivity, between two or more components to selectively separate the devices from the substrate. While such an approach may be effective at removing the devices from the substrate, it may be difficult to fabricate the devices with a desired degree of etch selectivity. Additionally or alternatively, a rate at which the separation occurs may be prohibitively slow, increasing an overall time needed to fabricate the devices and separate them from the substrate. Furthermore, the etch chemistries utilized to separate the devices from the substrate may be highly corrosive, caustic, acidic, and/or may not be environmentally friendly. Thus, there exists a need for improved systems and methods for separating components of a multilayer stack of electronic components.

SUMMARY

Systems and methods for separating components of a multilayer stack of electronic components are disclosed herein. The multilayer stack of electronic components includes a substrate, a sacrificial anode portion, a cathode portion, and an electronic assembly and may include an internal photovoltaic cell. The sacrificial anode portion extends between the electronic assembly and the substrate and also extends between the electronic assembly and the internal photovoltaic cell, when present. The internal photovoltaic cell, when present, extends between the sacrificial anode portion and the cathode portion.

In some embodiments, the sacrificial anode portion, the internal photovoltaic cell, and/or the electronic assembly are epitaxial structures. In some embodiments, the substrate forms an emitter of the internal photovoltaic cell and the internal photovoltaic cell further includes a base that is located between and electrically separates the substrate from the sacrificial anode portion. In some embodiments, the internal photovoltaic cell is operatively attached to the substrate. In some embodiments, the internal photovoltaic cell further includes a back surface field layer. In some embodiments, the multilayer stack is located within the electrically conductive fluid to form the electrochemical cell and the sacrificial anode portion is at least partially dissolved within the electrically conductive fluid.

When the multilayer stack is located within an electrically conductive fluid the methods include generating a potential difference between the cathode portion and the sacrificial anode portion and electrochemically oxidizing the sacrificial anode portion to dissolve the sacrificial anode portion within the electrically conductive fluid and separate the electronic assembly from the substrate. In some embodiments, and when the multilayer stack includes an internal power source (such as the internal photovoltaic cell) the generating includes generating with the internal power source (such as by directing electromagnetic radiation onto the internal photovoltaic cell). In some embodiments, the generating includes generating with an internal power source.

DESCRIPTION

Figure 1:
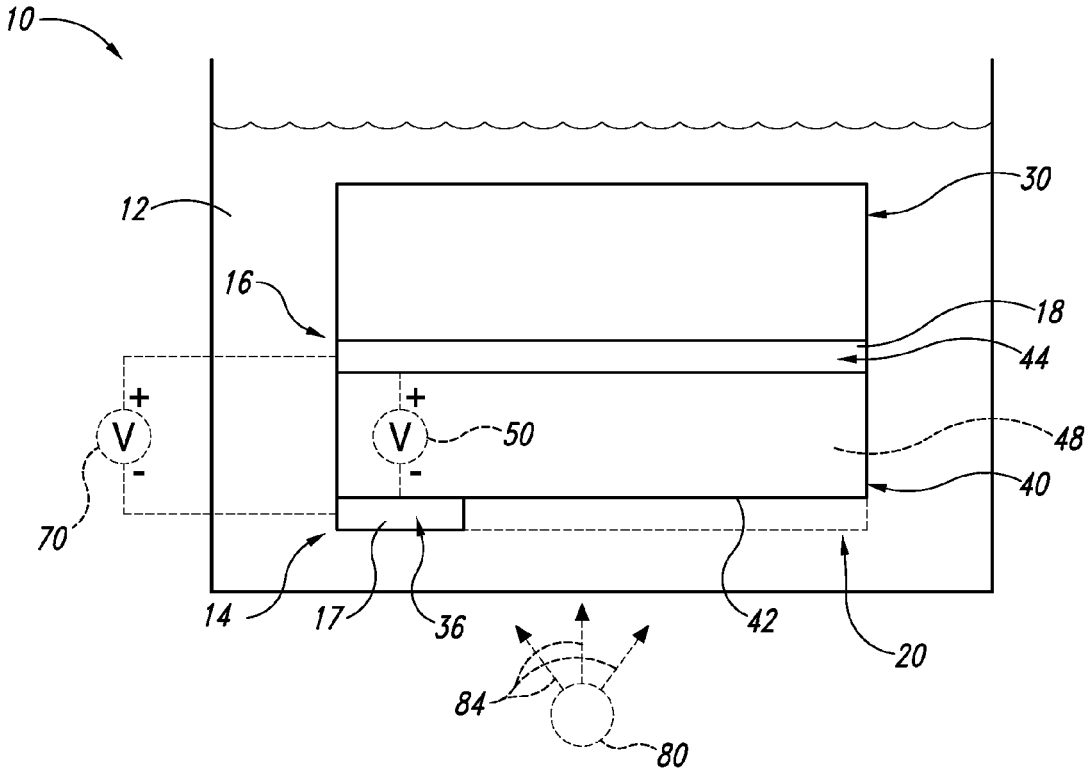
FIG. 1 is a schematic representation of illustrative, non-exclusive examples of an electrochemical cell that includes a multilayer stack that includes an electronic assembly, a substrate, a cathode portion, and a sacrificial anode portion according to the present disclosure.

FIGS. 1-5 provide illustrative, non-exclusive examples of electrochemical cells 10, multilayer stacks 20, and/or components thereof according to the present disclosure. Elements that serve a similar, or at least substantially similar, purpose are labeled with like numbers in each of FIGS. 1-5, and these elements may not be discussed in detail herein with reference to each of FIGS. 1-5. Similarly, all elements may not be labeled in each of FIGS. 1-5, but reference numerals associated therewith may be utilized herein for consistency. Elements, components, and/or features that are discussed herein with reference to one or more of FIGS. 1-5 may be included in and/or utilized with any of FIGS. 1-5 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic representation of illustrative, non-exclusive examples of a multilayer stack 20 according to the present disclosure that may be present in and/or form a portion of an electrochemical cell 10. Multilayer stack 20 of FIG. 1 includes at least an electronic assembly 30, a substrate 40, a cathode portion 36, and a sacrificial anode portion 44 and also may be referred to herein as a multilayer stack of electronic components. Substrate 40 includes, is operatively attached to, is in direct engagement with, is in electrical communication with, forms a portion of, and/or has formed thereon cathode portion 36 and also may include, be operatively attached to, be in direct engagement with, be in electrical communication with, form a portion of, and/or have formed thereon an internal photovoltaic cell 48.

As illustrated in FIG. 1, sacrificial anode portion 44 extends between electronic assembly 30 and substrate 40 and operatively attaches the electronic assembly to the substrate. In addition, sacrificial anode portion 44 also extends between and electrically separates electronic assembly 30 and internal photovoltaic cell 48, when present. FIG. 1 further illustrates that internal photovoltaic cell 48, when present, extends between and electrically separates sacrificial anode portion 44 from cathode portion 36, thereby permitting the internal photovoltaic cell to generate a potential difference between the sacrificial anode portion and the cathode portion, as discussed in more detail herein. In addition, sacrificial anode portion 44 also extends between and electrically separates electronic assembly 30 from cathode portion 36.

As also illustrated in FIG. 1, multilayer stack 20 may be located, at least partially immersed, and/or at least partially submerged within an electrically conductive fluid 12 to form electrochemical cell 10. Under these conditions, cathode portion 36 of electronic assembly 30 and electrically conductive fluid 12 together may form a first half-cell 14 of electrochemical cell 10, with cathode portion 36 functioning as a cathode 17 of the electrochemical cell. Similarly, sacrificial anode portion 44 of multilayer stack 20 and electrically conductive fluid 12 together may form a second half-cell 16 of electrochemical cell 10, with sacrificial anode portion 44 functioning as an anode 18 of the electrochemical cell.

Figure 2:
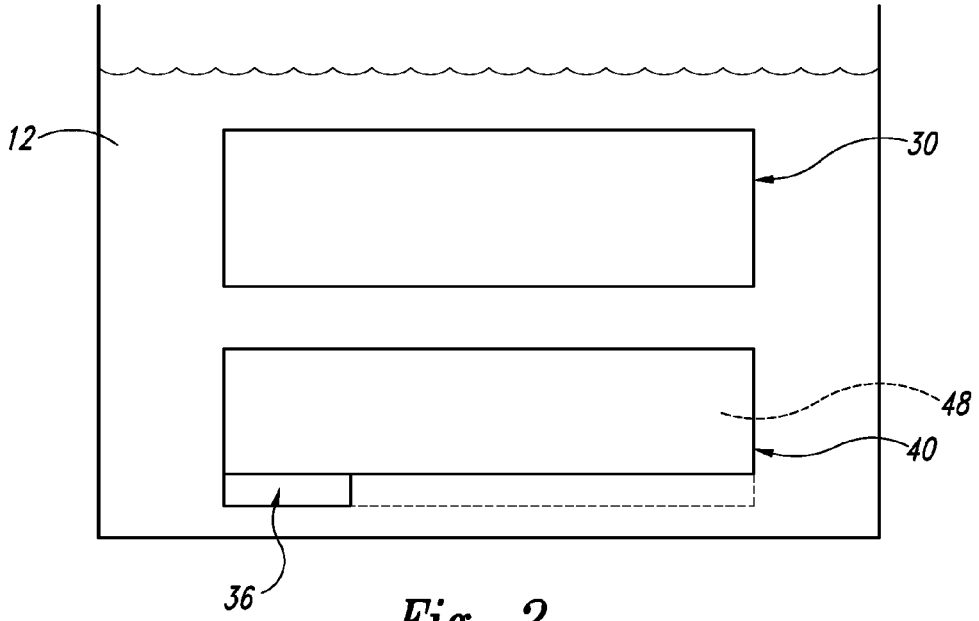
FIG. 2 is a schematic representation of illustrative, non-exclusive examples of the electronic assembly of FIG. 1 after being electrochemically separated from the substrate through dissolution of the sacrificial anode portion.

The systems and methods according to the present disclosure may include separating electronic assembly 30 from substrate 40 by dissolving sacrificial anode portion 44 within electrically conductive fluid 12. This may include electrochemically oxidizing sacrificial anode portion 44 to produce the dissolution thereof, and is illustrated in FIG. 2. Therein, sacrificial anode portion 44 has been dissolved within electrically conductive fluid 12, permitting separation of electronic assembly 30 from substrate 40.

Returning to FIG. 1, it is within the scope of the present disclosure that the electrochemical oxidation of sacrificial anode portion 44 may be powered in any suitable manner. As an illustrative, non-exclusive example, and when multilayer stack 20 includes internal photovoltaic cell 48, the systems and methods may include, and/or internal photovoltaic cell 48 may be in optical communication with, a source 80 of electromagnetic radiation 84 that is oriented to direct electromagnetic radiation 84 onto internal photovoltaic cell 48. This may include orienting source 80 such that electromagnetic radiation 84 is directed toward, or incident upon, a side 42 of substrate 40 that is opposed to sacrificial anode portion 44, as illustrated. Under these conditions, a wavelength and/or intensity of electromagnetic radiation 84 may be selected such that internal photovoltaic cell 48 functions as an internal power source 50 and generates a potential difference between cathode 17 and anode 18 of electrochemical cell 10 that is sufficient to produce the electrochemical oxidation of sacrificial anode portion 44, thereby dissolving sacrificial anode portion 44 within electrically conductive fluid 12.

Additionally or alternatively, and as another illustrative, non-exclusive example, electrochemical cell 10 may include and/or be in electrical communication with an external power source 70. Under these conditions, external power source 70 may generate the potential difference between cathode 17 and anode 18 of electrochemical cell 10 that is sufficient to produce the electrochemical oxidation of sacrificial anode portion 44, thereby dissolving sacrificial anode portion 44 within electrically conductive fluid 12.

Figure 3:
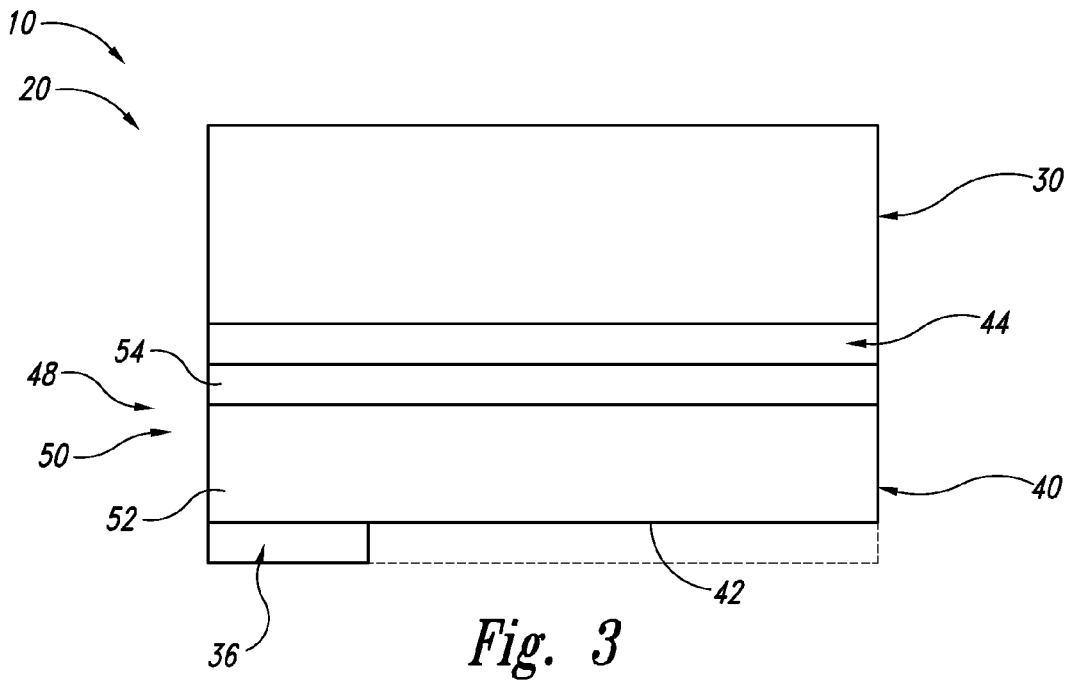
FIG. 3 provides less schematic but still illustrative, non-exclusive examples of a cross-sectional view of a multilayer stack according to the present disclosure that includes an electronic assembly, a substrate, an internal photovoltaic cell, a cathode portion, and a sacrificial anode portion.

FIG. 3 provides less schematic but still illustrative, non-exclusive examples of a cross-sectional view of a multilayer stack 20 according to the present disclosure that may form a portion of an electrochemical cell 10 (such as electrochemical cell 10 of FIGS. 1-2). Multilayer stack 20 of FIG. 3 includes an electronic assembly 30, a substrate 40, a sacrificial anode portion 44, a cathode portion 36, and an internal photovoltaic cell 48 that may function as an internal power source 50 and is at least partially defined by substrate 40.

In FIG. 3, internal photovoltaic cell 48 includes an emitter 52, which also may be referred to herein as an emitter layer 52, and a base 54, which also may be referred to herein as a base layer 54. Emitter 52 is defined by substrate 40 and base 54 is located between emitter 52 and sacrificial anode portion 44. Thus, and when electromagnetic radiation is incident upon side 42 of substrate 40, internal photovoltaic cell 48 may generate a potential difference between cathode portion 36 and sacrificial anode portion 44.

It is within the scope of the present disclosure that internal photovoltaic cell 48 of FIG. 3 may include any suitable materials of construction. As an illustrative, non-exclusive example, emitter 52 (or substrate 40) may include and/or be an n-type material (or substrate). As another illustrative, non-exclusive example, emitter 52 (or substrate 40) may include and/or be formed from Indium Phosphide.

As additional illustrative, non-exclusive examples, base 54 may include and/or be an epitaxial base layer and/or an epitaxially grown base layer that may be formed from a p-type material. Additionally or alternatively, base 54 may be formed from Indium Phosphide.

Figure 4:
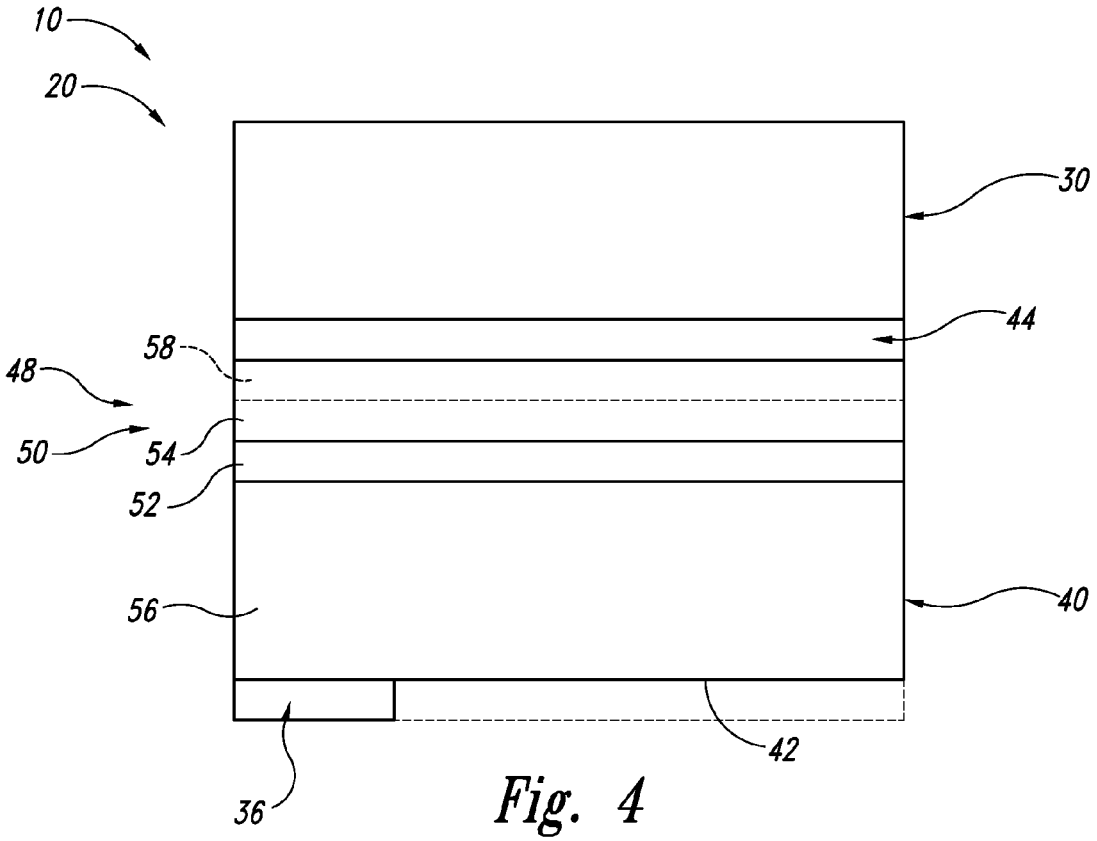
FIG. 4 provides less schematic but still illustrative, non-exclusive examples of a cross-sectional view of another multilayer stack according to the present disclosure that includes an electronic assembly, a substrate, an internal photovoltaic cell, a cathode portion, and a sacrificial anode portion.

FIG. 4 provides additional less schematic but still illustrative, non-exclusive examples of a cross-sectional view of a multilayer stack 20 according to the present disclosure that may form a portion of an electrochemical cell 10 (such as electrochemical cell 10 of FIG. 1). Multilayer stack 20 of FIG. 4 includes an electronic assembly 30, a substrate 40, a cathode portion 36, a sacrificial anode portion 44, and an internal photovoltaic cell 48 that may function as an internal power source 50.

In FIG. 4, internal photovoltaic cell 48 is located, or extends, between and electrically separates substrate 40 from sacrificial anode portion 44. Thus, internal photovoltaic cell 48 also may be referred to herein as being operatively attached to substrate 40, as being formed on a surface of substrate 40, and/or as being epitaxially grown from, or on, a surface of substrate 40.

Internal photovoltaic cell 48 includes an emitter 52 and a base 54 and also may include a back surface field (BSF) layer 58. As illustrated, emitter 52 extends between and electrically separates base 54 from substrate 40. As also illustrated, BSF layer 58, when present, extends between and electrically separates base 54 from sacrificial anode portion 44 and/or extends between and electrically separates a remainder of internal photovoltaic cell 48 from sacrificial anode portion 44.

In the illustrative, non-exclusive example of FIG. 4, substrate 40 may include and/or be an n-type substrate that may be formed from any suitable material, such as Indium Phosphide. In addition, substrate 40 may be an optically transparent substrate 40 that may function as and/or be a transparent window 56. Thus, substrate 40 may permit electromagnetic radiation that is incident upon side 42 to be transmitted through substrate 40 and thereby interact with, be absorbed by, and/or be incident upon internal photovoltaic cell 48 (or emitter 52 thereof).

It is within the scope of the present disclosure that internal photovoltaic cell 48 of FIG. 4 may include any suitable materials of construction. As an illustrative, non-exclusive example, emitter 52 may include and/or be an n-type material. As another illustrative, non-exclusive example, base 54 may include and/or be a p-type material. As yet another illustrative, non-exclusive example, BSF layer 58 may include and/or be a p-type material. Illustrative, non-exclusive examples of n-type materials and/or p-type materials that may be utilized with the systems and methods according to the present disclosure include Indium Phosphide, Indium Gallium Arsenide Phosphide, Aluminum Indium Arsenide, Aluminum Indium Gallium Arsenide, Gallium Arsenide Antimonide, and/or Aluminum Gallium Arsenide Antimonide.

Figure 5:
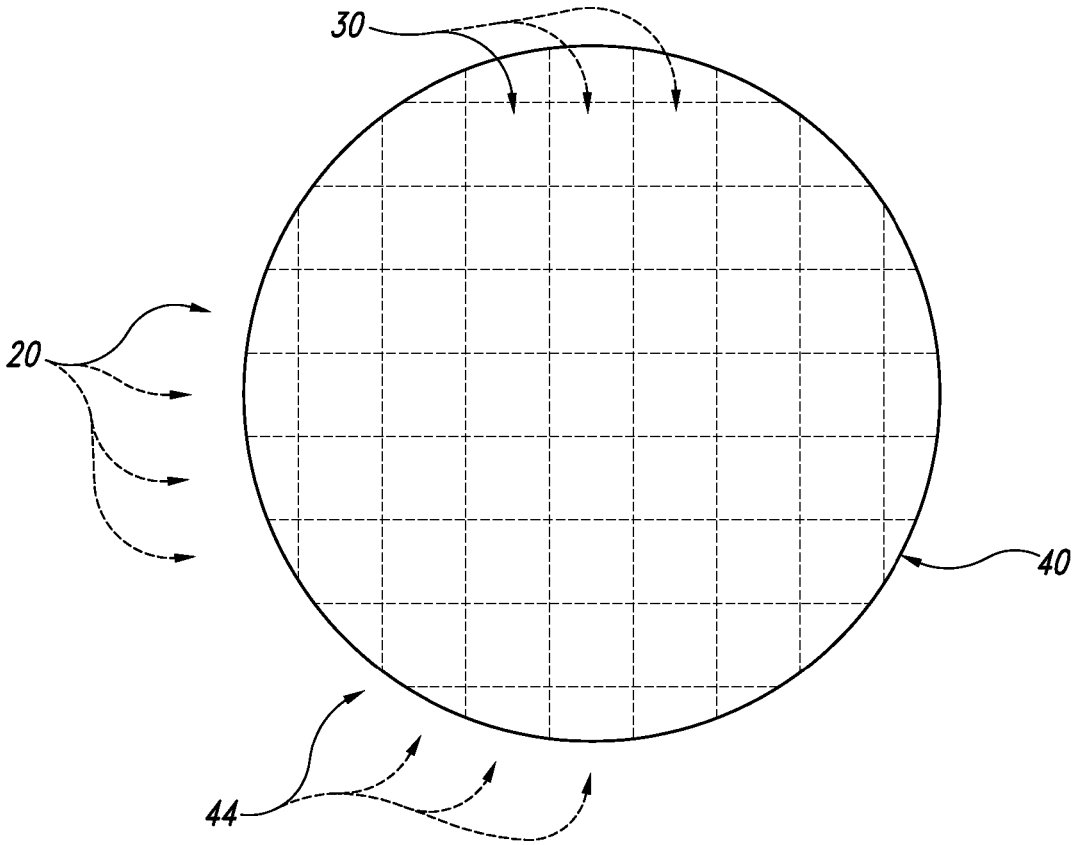
FIG. 5 provides a schematic top view of illustrative, non-exclusive examples of a substrate that includes at least one multilayer stack according to the present disclosure.

FIG. 5 provides a schematic top view of illustrative, non-exclusive examples of a substrate 40 that includes at least one multilayer stack 20 according to the present disclosure that include at least one electronic assembly 30. As illustrated in FIG. 5, substrate 40 may include and/or have formed thereon a single multilayer stack 20 that includes at least one electronic assembly 30. Alternatively, and as illustrated in dashed lines in FIG. 5, substrate 40 may include and/or have formed thereon a plurality of discrete, independent, and/or separate multilayer stacks 20, with each multilayer stack 20 including at least one electronic assembly 30.

It is within the scope of the present disclosure that electronic assembly 30 may be separated from substrate 40 (through dissolution of sacrificial anode portion 44) in any suitable manner. As an illustrative, non-exclusive example, and when substrate 40 includes a plurality of electronic assemblies 30 formed thereon, dissolution of sacrificial anode portion 44 may simultaneously singulate, or separate, the plurality of electronic assemblies 30 from one another. As another illustrative, non-exclusive example, and when substrate 40 includes the plurality of electronic assemblies 30 formed thereon, dissolution of sacrificial anode portion 44 may separate the plurality of electronic assemblies 30 from substrate 40 while retaining at least a portion of the plurality of electronic assemblies 30 in mechanical communication with, or operatively attached to, one another.

It is within the scope of the present disclosure that the various structures that are discussed herein with reference to FIGS. 1-5 may be formed from any suitable material, may be formed in any suitable manner, and/or may have any suitable geometry, conformation, and/or relative orientation. With this in mind, the following are additional illustrative, non-exclusive examples of materials, fabrication processes, geometries, and/or conformations of the various structures that may be utilized with the systems and methods according to the present disclosure. Further illustrative, non-exclusive examples of electrochemical cells 10, multilayer stacks 20, components thereof, and/or methods of utilizing the same are disclosed in U.S. patent application Ser. No. 13/777,334, which was filed on Feb. 26, 2013, the complete disclosure of which is hereby incorporated by reference.

Electronic assembly 30 may include and/or be any suitable device, electronic device, and/or optoelectronic device. As discussed, the systems and methods disclosed herein may be utilized to separate electronic assembly 30 from substrate 40 and/or multilayer stack 20, thereby permitting use and/or utilization of electronic assembly 30 independently from a remainder of multilayer stack 20. As an illustrative, non-exclusive example, and while not required to all embodiments, electronic assembly 30 may include and/or be an inverted photovoltaic cell and/or an inverted metamorphic solar cell that is designed, or configured, to convert light that is incident thereupon into an electric current. However, and during formation of the inverted photovoltaic cell, a side of the inverted photovoltaic cell that is designed to receive the light may be facing toward, may be operatively attached to, and/or may be in contact with sacrificial anode portion 44 and/or substrate 40. Thus, separation of electronic assembly 30 from a remainder of multilayer stack 20 may permit operation, or efficient operation, of electronic assembly 30. Additional illustrative, non-exclusive examples of electronic assembly 30 include any suitable upright photovoltaic cell, upright device, device layer, semiconductor device, III-V semiconductor device, optoelectronic device, and/or solar cell, and it is within the scope of the present disclosure that multilayer stack 20 (and/or electronic assembly 30 thereof) may include one or more barrier layers that may be located between sacrificial anode portion 44 and (a remainder of) electronic assembly 30 and that may be selected to chemically and/or electrically isolate (the remainder of) electronic assembly 30 from sacrificial anode layer 44.

It is within the scope of the present disclosure that electronic assembly 30 may be formed in any suitable manner and/or may include any suitable conformation and/or geometry. As an illustrative, non-exclusive example, electronic assembly 30 may include, be, be formed as, and/or be formed from an epitaxial layer that is grown on substrate 40 and may be referred to herein as and/or may be an epitaxial electronic assembly 30. As additional illustrative, non-exclusive examples, electronic assembly 30 may include and/or be a planar structure that may be continuous across a surface of substrate 40 (such as when substrate 40 includes a single electronic assembly 30) or may be discontinuous across the surface of substrate 40 (such as when substrate 40 includes a plurality of discrete electronic assemblies 30). Thus, electronic assembly 30 also may be referred to herein as a planar electronic assembly 30, a continuous planar electronic assembly 30, and/or a discontinuous planar electronic assembly 30.

Cathode portion 36 may include any suitable structure and/or material of construction. As illustrative, non-exclusive examples, cathode portion 36 may include and/or be an electrically conductive material and/or a metallic material. As additional illustrative, non-exclusive examples, cathode portion 36 also may include, be, and/or be referred to herein as a cathode layer, a cathode film, an electrically conductive cathode layer, an electrically conductive cathode film, an electroplated layer, an electroplated cathode layer, a deposited layer, a continuous cathode layer, and/or a discontinuous cathode layer. As an illustrative, non-exclusive example, and as illustrated in solid lines in FIGS. 1-4, cathode portion 36 may be discontinuous and/or may not form a continuous layer within multilayer stack 20. As another illustrative, non-exclusive example, and as illustrated in dashed lines in FIGS. 1-4, cathode portion 36 also may be a continuous layer within multilayer stack 20.

As discussed, cathode portion 36 is in electrical communication with substrate 40 and/or internal photovoltaic cell 48, when present. As illustrated in FIGS. 1-4, cathode portion 36 may be in direct physical engagement, or contact, with substrate 40. However, it is within the scope of the present disclosure that one or more layers, materials, and/or films may separate cathode portion 36 from substrate 40 and may provide electrical communication therebetween.

Substrate 40 may include any suitable structure that may include, form a portion of, and/or have formed thereon internal photovoltaic cell 48, cathode portion 36, sacrificial anode portion 44, and/or electronic assembly 30. As illustrative, non-exclusive examples, substrate 40 may include and/or be a semiconductor material, a semiconductor wafer, a III-V semiconductor material, a II-VI semiconductor material, Cadmium Indium Gallium Selenide, Silicon, Germanium, Indium Phosphide, and/or Gallium Arsenide.

As discussed, electronic assembly 30 may include and/or be an epitaxial electronic assembly 30 that may be epitaxially grown on substrate 40. As such, it is within the scope of the present disclosure that sacrificial anode portion 44, and/or internal photovoltaic cell 48 also may be epitaxially grown on substrate 40, as may be needed to permit formation of electronic assembly 30 on substrate 40 using epitaxial growth techniques.

Sacrificial anode portion 44 may include any suitable structure that may be located between electronic assembly 30 and substrate 40, may operatively attach electronic assembly 30 to substrate 40, may be formed on substrate 40, and/or may function as anode 18 for electrochemical cell 10 (as illustrated in FIG. 1). As an illustrative, non-exclusive example, sacrificial anode portion 44 may be formed from a different material and/or may have a different chemical composition than that of substrate 40, internal photovoltaic cell 48, cathode portion 36, and/or electronic assembly 30. As additional illustrative, non-exclusive examples, sacrificial anode portion 44 may include and/or be a semiconductor material, Silicon, Germanium, a III-V semiconductor material, Gallium Arsenide, Indium Gallium Arsenide, Indium Aluminum Arsenide, Aluminum Indium Gallium Arsenide, Arsenic Antimonide, Aluminum, an Antimonide, an Arsenide, and/or a Phosphide. As further illustrative, non-exclusive examples, sacrificial anode portion 44 may include, be, and/or be referred to herein as an epitaxial sacrificial anode portion, an epitaxial sacrificial anode layer, a sacrificial anode layer, a sacrificial anode film, a planar sacrificial anode layer, a continuous planar sacrificial anode layer, and/or a discontinuous planar sacrificial anode layer.

As illustrated in FIGS. 1 and 3-4, sacrificial anode portion 44 may be in direct engagement, or contact, with substrate 40 and/or internal photovoltaic cell 48. However, it is within the scope of the present disclosure that one or more intermediate layers may separate sacrificial anode portion 44 from substrate 40 and/or internal photovoltaic cell 48. When an intermediate layer separates sacrificial anode portion 44 from internal photovoltaic cell 48 the intermediate layer may provide electrical communication therebetween.

Internal photovoltaic cell 48 may include any suitable structure that may function as internal power source 50 within multilayer stack 20 and/or that may produce, or generate, the potential difference that may drive, or power, electrochemical dissolution of sacrificial anode portion 44 within electrochemical cell 10 (as discussed herein with reference to FIGS. 1-2). As an illustrative, non-exclusive example, internal photovoltaic cell 48 may include and/or be an inverted photovoltaic cell that is configured to provide the potential difference when electromagnetic radiation 84 is incident upon side 42 of substrate 40 (as illustrated in FIG. 1).

It is within the scope of the present disclosure that the potential difference that may be generated by internal photovoltaic cell 48 may define any suitable magnitude. As illustrative, non-exclusive examples, the magnitude of the generated potential difference may be at least 0.1 Volts (V), at least 0.2 V, at least 0.3 V, at least 0.4 V, at least 0.5 V, at least 0.6 V, at least 0.8 V, at least 1 V, at least 1.2 V, at least 1.4 V, or at least 1.6 V. As additional illustrative, non-exclusive examples, the generated potential difference that may be less than 5 V, less than 4.75 V, less than 4.5 V, less than 4.25 V, less than 4 V, less than 3.75 V, less than 3.5 V, less than 3.25 V, less than 3 V, less than 2.75 V, less than 2.5 V, less than 2.25 V, less than 2 V, less than 1.8 V, less than 1.6 V, less than 1.4 V, less than 1.2 V, less than 1 V, less than 0.8 V, less than 0.6 V, or less than 0.4 V.

In addition, internal photovoltaic cell 48 may be formed from any suitable material and/or may define any suitable conformation, including those that are discussed in more detail herein with reference to FIGS. 3-4. As additional but still illustrative, non-exclusive examples, internal photovoltaic cell 48 may include and/or be formed from a semiconductor material, Silicon, a III-V semiconductor material, Germanium, Indium Phosphide, Indium Gallium Arsenide Phosphide, Aluminum Indium Arsenide, Aluminum Indium Gallium Arsenide, Gallium Arsenide Antimonide, Aluminum Gallium Arsenide Antimonide, Antimony, Gallium Arsenide, and/or any suitable combination thereof. As further illustrative, non-exclusive examples, internal photovoltaic cell 48 may include, be, and/or be referred to herein as a homojunction device, a heterojunction device, an epitaxial internal photovoltaic cell, a planar internal photovoltaic cell, a continuous planar internal photovoltaic cell, and/or a discontinuous planar internal photovoltaic cell.

As illustrated in FIG. 3, internal photovoltaic cell 48 may be in direct engagement, or contact, with cathode portion 36 and/or with sacrificial anode portion 44. Alternatively, and as illustrated in FIG. 4, one or more intermediate layers and/or materials (such as substrate 40) may separate and/or extend between internal photovoltaic cell 48 and cathode portion 36 and/or sacrificial anode portion 44 while providing electrical communication between internal photovoltaic cell 48 and cathode portion 36 and/or sacrificial anode portion 44, respectively.

External power source 70 may include and/or be any suitable structure that may generate the potential difference between cathode portion 36 and sacrificial anode portion 44. As illustrative, non-exclusive examples, external power source 70 may include and/or be a direct current (DC) power supply and/or a programmable power supply. Illustrative, non-exclusive examples of the potential difference that may be generated by external power source 70 are discussed in more detail herein with reference to internal photovoltaic cell 48.

Source 80 of electromagnetic radiation 84 may include and/or be any suitable structure that may be adapted, configured, and/or designed to produce, or generate, electromagnetic radiation 84 and/or to direct electromagnetic radiation 84 onto (or incident upon) internal photovoltaic cell 48. Illustrative, non-exclusive examples of source 80 include any suitable light bulb, fluorescent light bulb, laser, light emitting diode (LED), and/or the sun. Illustrative, non-exclusive examples of electromagnetic radiation 84 include light, visible light, ultraviolet light, infrared light, fluorescent light, laser light, LED light, and/or sunlight.

Electrochemical cell 10 may include any suitable structure that may include and/or utilize multilayer stack 20 to form first half-cell 14 and second half-cell 16 (as illustrated in FIG. 1). First half-cell 14, which may be defined by electrically conductive fluid 12 and cathode portion 36, may define a first half-cell voltage, a magnitude of which may be dependent upon a composition of conductive solution 12 and a composition of cathode portion 36. Similarly, second half-cell 16, which may be defined by electrically conductive fluid 12 and sacrificial anode portion 44, may define a second half-cell voltage, a magnitude of which may be dependent upon the composition of conductive fluid 12 and a composition of sacrificial anode portion 44.

With reference to FIGS. 1-2, and when a magnitude of the potential difference between cathode portion 36 and sacrificial anode portion 44 is greater than a difference between the first half-cell voltage and the second half-cell voltage, sacrificial anode portion 44 will dissolve within conductive fluid 12. Thus, and as discussed in more detail herein, the magnitude of the potential difference may be selected based, at least in part, on the composition of cathode portion 36, the composition of sacrificial anode portion 44, and/or the composition of electrically conductive fluid 12. Additionally or alternatively, and as also discussed herein, the composition of cathode portion 36, the composition of sacrificial anode portion 44, and/or the composition of electrically conductive fluid 12 may be selected based, at least in part, on a desired, or target, magnitude of the potential difference (and/or on a magnitude of the potential difference that may be generated by internal photovoltaic cell 48, when present).

Electrically conductive fluid 12 may include any suitable composition that may form a portion of electrochemical cell 10, may form a portion of first half-cell 14, may form a portion of second half-cell 16, and/or may conduct an electric current, such as through conducting one or more ions, between cathode 17 and anode 18 (as illustrated in FIG. 1). As illustrative, non-exclusive examples, electrically conductive fluid 12 may include and/or be a liquid, a liquid solution, an electrolyte solution, a salt solution, and/or a dilute salt solution. As another illustrative, non-exclusive example, electrically conductive fluid 12 may include a solute dissolved in a solvent. Illustrative, non-exclusive examples of solutes that may be utilized with the systems and methods according to the present disclosure include a salt, sodium iodide, and sodium chloride. Illustrative, non-exclusive examples of solvents that may be utilized with the systems and methods according to the present disclosure include a liquid, an alcohol, isopropanol, and water. When the solvent includes water, electrically conductive fluid 12 also may be referred to herein as an aqueous solution 12 and/or as an aqueous electrically conductive fluid 12.

When electrically conductive fluid 12 includes a solute dissolved in a solvent, it is within the scope of the present disclosure that the solute may have, or define, any suitable concentration within the solvent. As illustrative, non-exclusive examples, the concentration of the solute may be at least 0.0001 molar (M), at least 0.0025 M, at least 0.005 M, at least 0.0075 M, at least 0.01 M, at least 0.02 M, at least 0.03 M, at least 0.04 M, at least 0.05 M, at least 0.06 M, at least 0.08 M, at least 0.1 M, at least 0.25 M, or at least 0.5 M. As additional illustrative, non-exclusive examples, the concentration of the solute may be less than 1 M, less than 0.75 M, less than 0.5 M, less than 0.25 M, less than 0.1 M, less than 0.075 M, less than 0.05 M, less than 0.025 M, less than 0.01 M, less than 0.009 M, less than 0.008 M, less than 0.007 M, less than 0.006 M, less than 0.005 M, less than 0.004 M, less than 0.003 M, less than 0.002 M, or less than 0.001 M.

Figure 6:
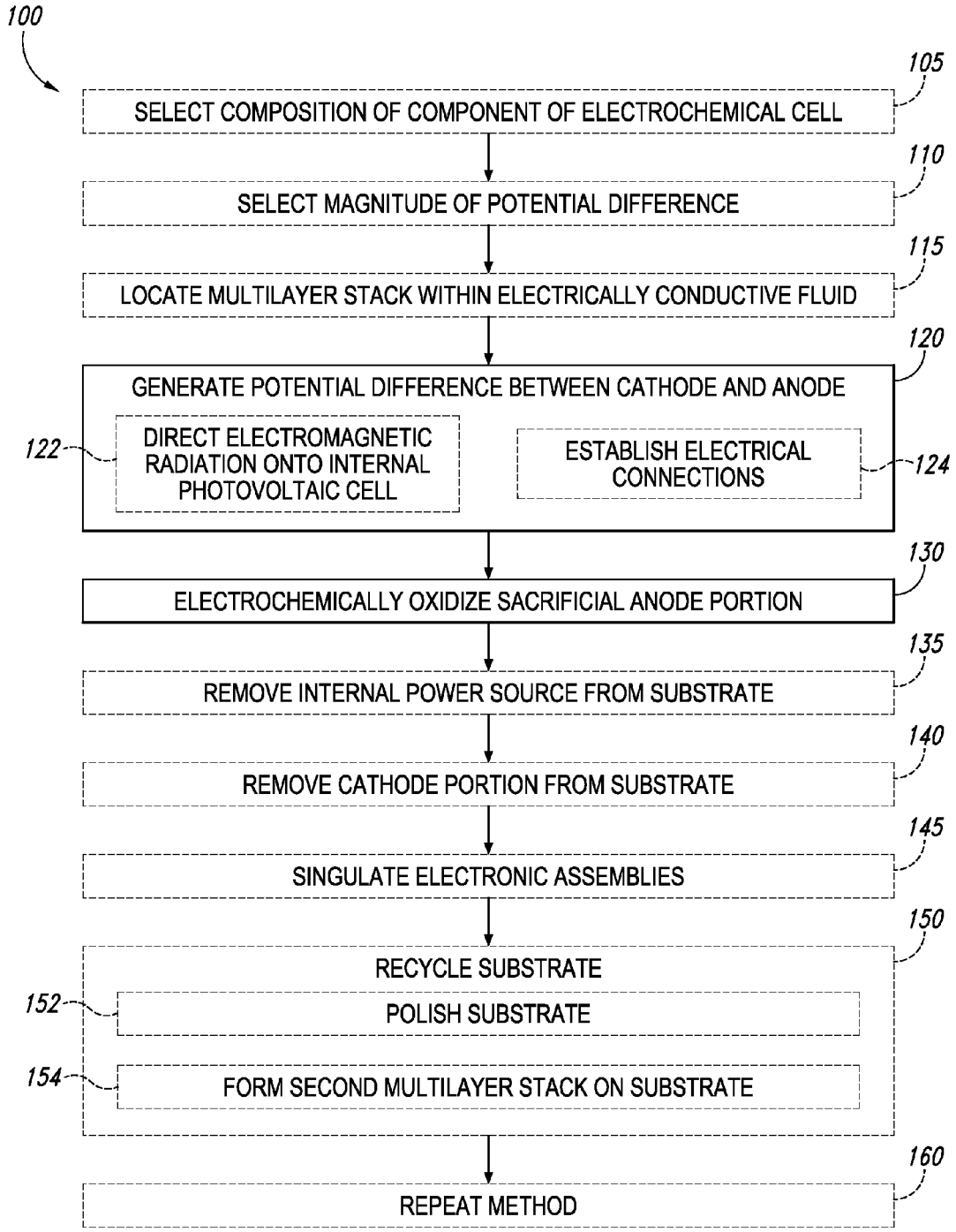
FIG. 6 is a flowchart depicting methods according to the present disclosure of separating an electronic assembly from a multilayer stack of electronic components.

FIG. 6 is a flowchart depicting methods 100 according to the present disclosure of separating an electronic assembly from a multilayer stack that includes the electronic assembly, a substrate, and a sacrificial anode portion that is located between the electronic assembly and the substrate and that operatively attaches the electronic assembly to the substrate. The multilayer stack is located within an electrically conductive fluid to form an electrochemical cell. Methods 100 may include selecting a composition of one or more components of the electrochemical cell at 105, selecting a magnitude of the potential difference at 110, and/or locating the multilayer stack within the electrically conductive fluid to form the electrochemical cell at 115 and include generating a potential difference between a cathode portion of the multilayer stack and the sacrificial anode portion at 120 and electrochemically oxidizing the sacrificial anode portion at 130 to dissolve the sacrificial anode portion within the electrically conductive fluid and separate the electronic assembly from the substrate. Methods 100 further may include removing an internal power source from the electronic assembly at 135, removing the cathode portion from the substrate at 140, singulating a plurality of electronic assemblies that are present on the substrate at 145, recycling the substrate at 150, and/or repeating the method at 160.

Selecting the composition of one or more components of the electrochemical cell at 105 may include selecting any suitable composition based, at least in part, on any suitable criteria. As illustrative, non-exclusive examples, the selecting may include selecting a chemical composition of the cathode portion, selecting a chemical composition of the sacrificial anode portion, and/or selecting a chemical composition of the electrically conductive fluid.

As discussed, the cathode portion and the electrically conductive fluid may define a first half-cell of the electrochemical cell. The first half-cell may define a first half-cell voltage, which may vary with the composition of the cathode portion and/or with the composition of the electrically conductive fluid. Similarly, the sacrificial anode portion and the electrically conductive fluid may define a second half-cell of the electrochemical cell. The second half-cell may define a second half-cell voltage, which may vary with the composition of the sacrificial anode portion and/or with the composition of the electrically conductive fluid.

As also discussed, a potential difference, or voltage, needed to electrochemically oxidize and dissolve the sacrificial anode portion within the electrically conductive fluid (at 130) may be defined based upon a difference between the first half-cell voltage and the second half-cell voltage. Thus, varying the composition at 105 may vary, change, and/or permit selection of a magnitude of the potential difference that may be needed to permit electrochemical dissolution of the sacrificial anode portion within the electrically conductive fluid.

With this in mind, the selecting at 105 may include selecting based, at least in part, on a target, or desired, magnitude of the potential difference. Additionally or alternatively, the selecting at 105 may include selecting such that the sacrificial anode portion will dissolve in the electrically conductive solution when the magnitude of the potential difference is at least the desired magnitude. As an illustrative, non-exclusive example, and when the generating at 120 includes generating with an internal photovoltaic cell (as discussed herein with reference to the generating at 120), the selecting at 105 may include selecting such that the magnitude of the potential difference that is produced by the internal photovoltaic cell, which also may be referred to herein as an operating voltage of the internal photovoltaic cell, is sufficient to produce electrochemical oxidation of the sacrificial anode portion (such as by being greater than or equal to the target magnitude of the potential difference).

Selecting the magnitude of the potential difference at 110 may include selecting the magnitude of the potential difference based upon any suitable criteria. As an illustrative, non-exclusive example, and as discussed, the magnitude of the potential difference may be selected such that the sacrificial anode portion will dissolve within the electrically conductive solution during the generating at 120 and/or during the electrochemically oxidizing at 130. This may include selecting the magnitude of the potential difference based upon the chemical composition of the cathode portion, the chemical composition of the anode portion, the chemical composition of the electrically conductive fluid, the first half-cell voltage, and/or the second half-cell voltage.

Locating the multilayer stack within the electrically conductive fluid to form the electrochemical cell at 115 may include fluidly contacting the cathode portion with the electrically conductive fluid and also fluidly contacting the sacrificial anode portion with the electrically conductive fluid. This may include at least partially immersing and/or submerging the multilayer stack, or at least the cathode portion and the sacrificial anode portion thereof, within the electrically conductive fluid. Regardless of the exact configuration, and subsequent to the locating at 115, the electrically conductive fluid provides electrical communication between the cathode portion and the sacrificial anode portion, thereby forming the electrochemical cell.

Generating the potential difference between the cathode portion and the sacrificial anode portion at 120 may include generating the potential difference such that the cathode portion forms, functions as, and/or is a cathode of the electrochemical cell and such that the sacrificial anode portion forms, functions as, and/or is an anode of the electrochemical cell. This may include selecting a magnitude and/or polarity of the potential difference such that the cathode portion forms the cathode and such that the sacrificial anode portion forms the anode.

As an illustrative, non-exclusive example, and as discussed herein, the multilayer stack may include an internal power source that is located between and in electrical communication with the cathode portion and the sacrificial anode portion. The internal power source may include and/or be an internal photovoltaic cell that is configured to generate the potential difference upon receipt of electromagnetic radiation. Under these conditions, the generating at 120 may include generating with the internal power source. This may include directing the electromagnetic radiation onto, into contact with, and/or incident upon the internal photovoltaic cell at 122 to generate the potential difference at 120. As discussed herein, the directing at 122 may include directing the electromagnetic radiation to be incident upon a side of the substrate that is opposed to the sacrificial anode and/or conveying the electromagnetic radiation through the substrate and onto, into contact with, and/or incident upon the internal photovoltaic cell.

When the generating at 120 includes generating with the internal power source, the electrochemically oxidizing at 130 further may include separating the internal power source from the electronic assembly. Additionally or alternatively, the separating at 130 also may include separating the internal power source from the electronic assembly while maintaining mechanical communication between the internal power source and the substrate and/or while maintaining the internal power source intact on, or with, the substrate.

As another illustrative, non-exclusive example, and as also discussed herein, the multilayer stack may be in electrical communication with an external power source that is configured to generate the potential difference. Under these conditions, the generating at 120 may include generating with the external power source, and methods 100 may include, at 124, establishing a first electrical connection between the cathode portion and a negative terminal of the external power source and/or establishing a second electrical connection between the sacrificial anode portion and a positive terminal of the external power source.

Regardless of the exact mechanism that may be utilized during the generating at 120, the generating may include generating a potential difference (or voltage) that is of sufficient magnitude and correct polarity to electrochemically oxidize the sacrificial anode portion and thereby dissolve the sacrificial anode portion within the electrically conductive fluid. Illustrative, non-exclusive examples of magnitudes (voltages) of the potential difference are discussed herein.

Additionally or alternatively, and as discussed, the generated potential difference may be greater than the difference between the first half-cell voltage and the second half-cell voltage. As illustrative, non-exclusive examples, the generated potential difference may be at least 105%, at least 110%, at least 115%, at least 120%, at least 130%, at least 140%, at least 150%, at least 160%, at least 170%, at least 180%, at least 190%, or at least 200% of the difference between the first half-cell voltage and the second half-cell voltage.

Electrochemically oxidizing the sacrificial anode portion at 130 may include dissolving the sacrificial anode portion within the electrically conductive fluid to separate the electronic assembly from the substrate. As discussed, and prior to the electrochemically oxidizing at 130, the sacrificial anode portion operatively attaches the electronic assembly to the substrate. Thus, and as also discussed, dissolution of the sacrificial anode portion within the electrically conductive fluid removes this operative attachment, thereby permitting separation of the electronic assembly from the substrate.

As used herein, the phrase "electrochemically oxidizing the sacrificial anode portion" may include utilizing the potential difference that was generated during the generating at 120 as a motive, or driving, force for oxidation of the sacrificial anode portion. In the systems and methods that are disclose herein, the sacrificial anode portion may not dissolve within the electrically conductive fluid, may not dissolve to a significant amount within the electrically conductive fluid, and/or may not dissolve within the electrically conductive fluid at an economically viable dissolution rate unless the potential difference is applied between the sacrificial anode portion and the cathode portion, such as via the generating at 120.

Thus, and in the context of the present disclosure, the phrase "electrochemically oxidizing the sacrificial anode portion" further may include oxidizing the sacrificial anode portion by removing electrons from atoms that are present within the sacrificial anode portion to ionize the atoms and produce dissolution thereof. The magnitude and polarity of the applied potential difference is such that the removed electrons flow from the sacrificial anode portion to a power source, such as internal power source 50 and/or external power source 70, that generates the potential difference. This is in contrast with chemical etch processes, wherein atoms of an etched material chemically react with and/or are oxidized by an etchant chemical to produce dissolution thereof. With the above discussion in mind, the electrochemically oxidizing the sacrificial anode portion at 130 also may be referred to herein as and/or may be electrochemically etching the sacrificial anode portion, electrochemically dissolving the sacrificial anode portion, and/or utilizing the potential difference that is generated during the generating at 120 as a driving force to dissolve the sacrificial anode portion within the electrically conductive fluid.

It is within the scope of the present disclosure that the electrochemically oxidizing at 130 may include separating the electronic assembly from the substrate without etching the sacrificial anode portion, without chemically etching the sacrificial anode portion, and/or without significant etching of the sacrificial anode portion. Thus, the systems and methods disclosed herein may permit separation of the electronic assembly from the substrate without the inclusion of a corrosive material, such as an acid, a strong acid, a base, a strong base, hydrofluoric acid, succinic acid, ammonium hydroxide, and/or hydrogen peroxide within the electrically conductive fluid during the electrochemically oxidizing at 130.

Additionally or alternatively, the systems and methods disclosed herein also may permit separation of the electronic assembly from the substrate without mechanically peeling the electronic assembly from the substrate. However, it is within the scope of the present disclosure that the electrically conductive fluid further may include one or more corrosive materials and/or that the methods further may include mechanically peeling, either of which may increase a rate of separation that may be produced by the electrochemically oxidizing at 130.

When the multilayer stack includes the internal power source, and as discussed, the electrochemically oxidizing at 130 may include separating the internal power source from the electronic assembly and/or maintaining operative attachment between the internal power source and the substrate. Under these conditions, methods 100 further may include removing the internal power source (or at least a portion thereof) from the substrate at 135. Removing the internal power source from the substrate at 135 may include removing the internal power source in any suitable manner. As illustrative, non-exclusive examples, the removing at 135 may include dissolving the internal power source and/or etching the internal power source to remove the internal power source from the substrate.

As discussed herein, the multilayer stack further includes a cathode portion that may be operatively attached to and/or formed on the substrate. Under these conditions, it further may be desirable to remove the cathode portion from the substrate. Thus, methods 100 further may include removing the cathode portion from the substrate at 140. The removing at 140 may be accomplished in any suitable manner, including dissolution of the cathode portion and/or etching of the cathode portion.

As discussed herein, the substrate may include a plurality of electronic assemblies formed thereon. Under these conditions, it may be desirable to separate at least a portion of the plurality of electronic assemblies from a remainder of the plurality of electronic assemblies. Thus, methods 100 further may include singulating the plurality of electronic assemblies that are present on the substrate at 145.

It is within the scope of the present disclosure that the singulating at 145 may be performed concurrently with the electrochemically oxidizing at 130 or subsequent to the electrochemically oxidizing at 130. As an illustrative, non-exclusive example, the sacrificial anode portion may operatively attach the plurality of electronic assemblies to the substrate and the multilayer stack may not include another structure that operatively attaches the plurality of electronic assemblies to one another. Under these conditions, the electrochemically oxidizing at 130 also may accomplish the singulating at 145 through dissolution of the sacrificial anode portion (thus, the singulating at 145 may be performed concurrently with the electrochemically oxidizing at 130). As another illustrative, non-exclusive example, the multilayer stack may include one or more additional structures that may operatively attach the plurality of electronic assemblies to one another. Under these conditions, the singulating at 145 may be a separate step that is performed subsequent to the electrochemically oxidizing at 130.

Recycling the substrate at 150 may include recycling the substrate in any suitable manner and may be performed subsequent to the electrochemically oxidizing at 130. As an illustrative, non-exclusive example, the recycling at 150 may include polishing the substrate at 152, such as to decrease a surface roughness thereof. As another illustrative, non-exclusive example, the multilayer stack may be a first multilayer stack and the recycling at 150 may include forming a second multilayer stack on the substrate at 154. The second multilayer stack may include a second electronic assembly, the substrate, and a second sacrificial anode portion and may be at least substantially similar to the first multilayer stack. Additionally or alternatively, the second multilayer stack also may be different from the first multilayer stack.

When methods 100 include the removing at 135, the internal power source may be a first internal power source and the recycling at 150 further may include forming a second internal power source as part of the second multilayer stack, prior to forming the second sacrificial anode layer, and/or prior to forming the second electronic assembly. Additionally or alternatively, the recycling at 150 also may include re-using the internal power source (such as when methods 100 do not include the removing at 135).

Similarly, and when methods 100 include the removing at 140, the cathode portion may be a first cathode portion and the recycling at 150 may include forming a second cathode portion as part of the second multilayer stack, prior to forming the second sacrificial anode layer, and/or prior to forming the second electronic assembly. Additionally or alternatively, the recycling at 150 also may include re-using the cathode portion (such as when methods 100 do not include the removing at 140).

When methods 100 include the forming the second multilayer stack at 154, methods 100 further may include repeating the methods at 160. Repeating the methods at 160 may include repeating any suitable portion of methods 100. As an illustrative, non-exclusive example, the repeating at 160 may include repeating at least the generating at 120 and the electrochemically oxidizing at 130 to separate the second electronic assembly from the substrate. This process may be repeated any suitable number of times to form any suitable number of electronic assemblies on the substrate and to subsequently remove the electronic assemblies from the substrate. As illustrative, non-exclusive examples, the repeating at 160 may include repeating at least 3, at least 4, at least 5, at least 6, at least 8, at least 10, at least 15, or at least 20 times.

Illustrative, non-exclusive examples of inventive subject matter according to the present disclosure are described in the following enumerated paragraphs:

A1. A method of separating an electronic assembly from a multilayer stack of electronic components that includes the electronic assembly, a substrate, a cathode portion, and a sacrificial anode portion that is located between the electronic assembly and the substrate and that operatively attaches the electronic assembly to the substrate, wherein the multilayer stack is located within an electrically conductive fluid and forms an electrochemical cell, the method comprising:

generating a potential difference between the cathode portion and the sacrificial anode portion such that the cathode portion forms a cathode of the electrochemical cell and the sacrificial anode portion forms an anode of the electrochemical cell; and electrochemically oxidizing the sacrificial anode portion to dissolve the sacrificial anode portion within the electrically conductive fluid and separate the electronic assembly from the substrate.

A2. The method of paragraph A1, wherein the multilayer stack includes an internal power source that is located between and in electrical and mechanical communication with the cathode portion and the sacrificial anode portion, wherein the sacrificial anode portion is located between the internal power source and the electronic assembly, and further wherein the generating includes generating the potential difference with the internal power source.

A3. The method of paragraph A2, wherein the internal power source includes an internal photovoltaic cell, and further wherein the method includes:

directing electromagnetic radiation onto the internal photovoltaic cell to initiate the generating, optionally wherein the directing includes directing the electromagnetic radiation to be incident upon a side of the substrate that is opposed to the sacrificial anode, and further optionally wherein the method includes conveying the electromagnetic radiation through the substrate and onto the internal photovoltaic cell.

A4. The method of paragraph A3, wherein the electromagnetic radiation includes at least one of light, visible light, infrared light, ultraviolet light, fluorescent light, laser light, LED light, and sunlight.

A5. The method of any of paragraphs A2-A4, wherein, the electrochemically oxidizing includes separating the internal power source from the electronic assembly while maintaining mechanical communication between the internal power source and the substrate.

A6. The method of any of paragraphs A2-A5, further comprising:

removing the internal power source from the substrate.

A7. The method of paragraph A6, wherein the removing the internal power source includes at least one of dissolving the internal power source and etching the internal power source.

A8. The method of any of paragraphs A1-A7, further comprising:

removing the cathode portion from the substrate.

A9. The method of paragraph A8, wherein the removing the cathode portion includes at least one of dissolving the cathode portion and etching the cathode portion.

A10. The method of any of paragraphs A1-A9, further comprising:

establishing a first electrical connection between the cathode portion and a negative terminal of an external power source; and establishing a second electrical connection between the sacrificial anode portion and a positive terminal of the external power source, wherein the generating includes generating the potential difference with the external power source.

A11. The method of paragraph A10, wherein the external power source includes a direct current external power source.

A12. The method of any of paragraphs A1-A11, wherein the multilayer stack is a first multilayer stack, wherein the electronic assembly is a first electronic assembly of the first multilayer stack, wherein the sacrificial anode portion is a first sacrificial anode portion of the first multilayer stack, and further wherein, subsequent to the electrochemically oxidizing, the method further comprises:

forming a second multilayer stack that includes a second electronic assembly, the substrate, and a second sacrificial anode portion that is located between the second electronic assembly and the substrate and that operatively attaches the second electronic assembly to the substrate.

A13. The method of paragraph A12 when dependent from paragraph A6, wherein the internal power source is a first internal power source, and further wherein the method further comprises:

forming a second internal power source such that the second internal power source is located between and in mechanical and electrical communication with the second sacrificial anode portion and the cathode portion.

A14. The method of any of paragraphs A12-A13 when dependent from paragraph A8, wherein the cathode portion is a first cathode portion, and further wherein the method comprises:

forming a second cathode portion such that the internal power source (or the second internal power source) is located between and in mechanical and electrical communication with the second sacrificial anode portion and the second cathode portion.

A15. The method of any of paragraphs A12-A14, wherein, prior to the forming a second multilayer stack and subsequent to the electrochemically oxidizing, the method further comprises:

polishing the substrate.

A16. The method of any of paragraphs A12-A15, wherein the method further comprises:

repeating at least the generating and the electrochemically oxidizing to separate the second electronic assembly from the substrate, optionally wherein the repeating the generating includes re-using a/the internal power source to generate the potential difference.

A17. The method of paragraph A16, wherein the method further comprises:

repeating the method a plurality of times to separate a plurality of electronic assemblies from the substrate, optionally wherein the repeating includes repeating at least 3, at least 4, at least 5, at least 6, at least 8, at least 10, at least 15, or at least 20 times, optionally to separate at least a respective number of electronic assemblies from the substrate.

A18. The method of any of paragraphs A1-A17, further comprising:

selecting a chemical composition of at least one, optionally at least two, optionally all, of the cathode portion, the anode portion, and the electrically conductive fluid.

A19. The method of paragraphs A18, wherein the selecting the chemical composition is based, at least in part, on a desired magnitude of the potential difference.

A20. The method of paragraph A19, wherein the selecting the chemical composition includes selecting such that the sacrificial anode portion will dissolve within the electrically conductive fluid when a magnitude of the potential difference is at least the desired magnitude.

A21. The method of any of paragraphs A19-A20, wherein the multilayer stack includes a/the internal photovoltaic cell that is in electrical communication with the cathode portion and the sacrificial anode portion, wherein the internal photovoltaic cell defines an operating voltage, and further wherein the desired magnitude of the potential difference is based on, or less than, the operating voltage of the internal photovoltaic cell.

A22. The method of any of paragraphs A1-A19, further comprising:

selecting a magnitude of the generated potential difference.

A23. The method of paragraph A22, wherein the selecting the magnitude is based, at least in part, on a/the chemical composition of at least one, optionally at least two, optionally all, of the cathode portion, the anode portion, and the electrically conductive fluid.

A24. The method of any of paragraphs A1-A23, further comprising:

separating the electronic assembly from the substrate without etching the sacrificial anode portion.

A25. The method of any of paragraphs A1-A24, wherein the electrically conductive fluid does not include at least one, and optionally any, of an acid, a strong acid, a base, a strong base, a corrosive material, hydrofluoric acid, succinic acid, ammonium hydroxide, and hydrogen peroxide.

A26. The method of any of paragraphs A1-A25, further comprising:

separating the electronic assembly from the substrate without mechanically peeling the electronic assembly from the substrate.

A27. The method of any of paragraphs A1-A26, wherein the sacrificial anode portion includes at least one of a semiconductor material, Silicon, Germanium, a III-V semiconductor material, Gallium Arsenide, Indium Gallium Arsenide, Indium Aluminum Arsenide, Aluminum Indium Gallium Arsenide, Arsenic Antimonide, Aluminum, an Antimonide, an Arsenide, and a Phosphide.

A28. The method of any of paragraphs A1-A27, wherein the substrate includes at least one of a semiconductor material, Silicon, a III-V semiconductor material, a II-VI semiconductor material, Cadmium Indium Gallium Selenide, Germanium, Indium Phosphide, and Gallium Arsenide.

A29. The method of any of paragraphs A1-A28, wherein the generating a potential difference includes generating a potential difference that is at least one of:

(i) at least 0.1 Volts (V), at least 0.2 V, at least 0.3 V, at least 0.4 V, at least 0.5 V, at least 0.6 V, at least 0.8 V, at least 1 V, at least 1.2 V, at least 1.4 V, or at least 1.6 V; and (ii) less than 5 V, less than 4.75 V, less than 4.5 V, less than 4.25 V, less than 4 V, less than 3.75 V, less than 3.5 V, less than 3.25 V, less than 3 V, less than 2.75 V, less than 2.5 V, less than 2.25 V, less than 2 V, less than 1.8 V, less than 1.6 V, less than 1.4 V, less than 1.2 V, less than 1 V, less than 0.8 V, less than 0.6 V, or less than 0.4 V.

A30. The method of any of paragraphs A1-A29, wherein the cathode portion and the electrically conductive fluid define a first half-cell that defines a first half-cell voltage, wherein the sacrificial anode portion and the electrically conductive fluid define a second half-cell that defines a second half-cell voltage, and further wherein the generating a potential difference includes generating a potential difference that is greater than a difference between the first half-cell voltage and the second half-cell voltage.

A31. The method of paragraph A30, wherein the generating a potential difference includes generating a potential difference that is at least 105%, at least 110%, at least 115%, at least 120%, at least 130%, at least 140%, at least 150%, at least 160%, at least 170%, at least 180%, at least 190%, or at least 200% of the difference between the first half-cell voltage and the second half-cell voltage.

A32. The method of any of paragraphs A1-A31, wherein the cathode portion includes at least one of an electrically conductive material and a metallic material.

A33. The method of any of paragraphs A1-A32, wherein the cathode portion includes at least one of a cathode layer, a cathode film, an electrically conductive cathode layer, an electrically conductive cathode film, an electroplated cathode layer, a deposited layer, a continuous cathode layer, and a discontinuous cathode layer.

A34. The method of any of paragraphs A1-A33, wherein the electronic assembly includes at least one of a device layer, a semiconductor device, an optoelectronic device, a III-V semiconductor device, a photovoltaic cell, an upright device, an upright photovoltaic cell, an inverted photovoltaic cell, and an inverted metamorphic solar cell.

A35. The method of any of paragraphs A1-A34, wherein the sacrificial anode portion includes at least one of a sacrificial anode layer, a sacrificial anode film, an epitaxially grown sacrificial anode layer, a continuous sacrificial anode layer, and a discontinuous sacrificial anode layer.

A36. The method of any of paragraphs A1-A35, wherein the substrate includes a plurality of electronic assemblies, and the method further comprising:

singulating the plurality of electronic assemblies.

A37. The method of paragraph A36, wherein the singulating includes at least one of singulating concurrently with the electrochemically oxidizing and singulating subsequent to the electrochemically oxidizing.

A38. The method of any of paragraphs A1-A37, wherein the electrically conductive fluid includes at least one of an electrolyte solution, a salt solution, and a dilute salt solution.

A39. The method of any of paragraphs A1-A38, wherein the electrically conductive fluid includes a solute dissolved in a solvent.

A40. The method of paragraph A39, wherein a concentration of the solute is at least one of:

(i) at least 0.0001 molar (M), at least 0.0025 M, at least 0.005 M, at least 0.0075 M, at least 0.01 M, at least 0.02 M, at least 0.03 M, at least 0.04 M, at least 0.05 M, at least 0.06 M, at least 0.08 M, at least 0.1 M, at least 0.25 M, or at least 0.5 M; and (ii) less than 1 M, less than 0.75 M, less than 0.5 M, less than 0.25 M, less than 0.1 M, less than 0.075 M, less than 0.05 M, less than 0.025 M, less than 0.01 M, less than 0.009 M, less than 0.008 M, less than 0.007 M, less than 0.006 M, less than 0.005 M, less than 0.004 M, less than 0.003 M, less than 0.002 M, or less than 0.001 M.

A41. The method of any of paragraphs A39-A40, wherein the solute includes at least one of a salt, sodium iodide, and sodium chloride.

A42. The method of any of paragraphs A39-A41, wherein the solvent includes at least one of water, an alcohol, and isopropanol.

A43. The method of any of paragraphs A1-A42, wherein the method further includes locating the multilayer stack within the electrically conductive fluid to form the electrochemical cell.

A44. The method of any of paragraphs A1-A43 performed using the multilayer stack of any of paragraphs B1-B30, and optionally wherein the method further includes providing the multilayer stack of any of paragraphs B1-B30.

A45. The method of any of paragraphs A1-A43 performed using the electrochemical cell of any of paragraphs C1-C7, and optionally wherein the method further includes providing the electrochemical cell of any of paragraphs C1-C7.

B1. A multilayer stack of electronic components, comprising:

a substrate;

an internal photovoltaic cell;

a sacrificial anode portion;

a cathode portion; and an electronic assembly;

wherein:

(i) the sacrificial anode portion extends between the electronic assembly and the substrate and operatively attaches the electronic assembly to the substrate;

(ii) the sacrificial anode portion extends between and electrically separates the electronic assembly from the internal photovoltaic cell; and (iii) the internal photovoltaic cell extends between and electrically separates the sacrificial anode portion from the cathode portion.

B2. The multilayer stack of paragraph B1, wherein the sacrificial anode portion extends between and electrically separates the electronic assembly from the cathode portion.

B3. The multilayer stack of any of paragraphs B1-B2, wherein the substrate includes at least one of a semiconductor material, a semiconductor wafer, Silicon, Germanium, a III-V semiconductor material, a II-VI semiconductor material, Cadmium Indium Gallium Selenide, Indium Phosphide, and Gallium Arsenide.

B4. The multilayer stack of any of paragraphs B1-B3, wherein the sacrificial anode portion includes at least one of a semiconductor material, Silicon, Germanium, a III-V semiconductor material, Gallium Arsenide, Indium Gallium Arsenide, Indium Aluminum Arsenide, Aluminum Indium Gallium Arsenide, Arsenic Antimonide, Aluminum, an Antimonide, an Arsenide, and a Phosphide.

B5. The multilayer stack of any of paragraphs B1-B4, wherein the sacrificial anode portion is an epitaxial, or epitaxially grown, sacrificial anode portion.

B6. The multilayer stack of any of paragraphs B1-B5, wherein the sacrificial anode portion is in direct engagement with at least one of the substrate and the internal photovoltaic cell.

B7. The multilayer stack of any of paragraphs B1-B6, wherein the sacrificial anode portion includes a planar sacrificial anode layer, optionally a continuous planar sacrificial anode layer, and further optionally a discontinuous planar sacrificial anode layer.

B8. The multilayer stack of any of paragraphs B1-B7, wherein the internal photovoltaic cell is configured to receive electromagnetic radiation and to generate a potential difference between the sacrificial anode portion and the cathode portion responsive to receipt of the electromagnetic radiation.

B9. The multilayer stack of paragraph B8, wherein the internal photovoltaic cell is configured to generate the potential difference when the electromagnetic radiation is incident upon a side of the substrate that is opposed to the sacrificial anode portion.

B10. The multilayer stack of any of paragraphs B8-B9, wherein the potential difference includes a potential difference that is at least one of:

(i) at least 0.1 Volts (V), at least 0.2 V, at least 0.3 V, at least 0.4 V, at least 0.5 V, at least 0.6 V, at least 0.8 V, at least 1 V, at least 1.2 V, at least 1.4 V, or at least 1.6 V; and (ii) less than 5 V, less than 4.75 V, less than 4.5 V, less than 4.25 V, less than 4 V, less than 3.75 V, less than 3.5 V, less than 3.25 V, less than 3 V, less than 2.75 V, less than 2.5 V, less than 2.25 V, less than 2 V, less than 1.8 V, less than 1.6 V, less than 1.4 V, less than 1.2 V, less than 1 V, less than 0.8 V, less than 0.6 V, or less than 0.4 V.

B11. The multilayer stack of any of paragraphs B1-B10, wherein the internal photovoltaic cell includes, or is, an epitaxial, or epitaxially grown, internal photovoltaic cell.

B12. The multilayer stack of any of paragraphs B1-B11, wherein the internal photovoltaic cell includes a planar internal photovoltaic cell, optionally a continuous planar internal photovoltaic cell, and further optionally a discontinuous planar internal photovoltaic cell.

B13. The multilayer stack of any of paragraphs B1-B12, wherein the internal photovoltaic cell is in direct engagement with at least one, and optionally both, of the cathode portion and the sacrificial anode portion.

B14. The multilayer stack of any of paragraphs B1-B13, wherein the internal photovoltaic cell is formed from at least one of a semiconductor material, Silicon, Germanium, a III-V semiconductor material, Indium Phosphide, Indium Gallium Arsenide Phosphide, Aluminum Indium Arsenide, Aluminum Indium Gallium Arsenide, Gallium Arsenide Antimonide, Aluminum Gallium Arsenide Antimonide, Antimony, Indium, Phosphorus, Gallium, Arsenic, and Gallium Arsenide.

B15. The multilayer stack of any of paragraphs B1-B14, wherein the substrate is an electrically conductive substrate.

B16. The multilayer stack of any of paragraphs B1-B15, wherein the substrate forms a portion of the internal photovoltaic cell and/or the internal photovoltaic cell forms a portion of the substrate.

B17. The multilayer stack of any of paragraph B1-B16, wherein the substrate forms an emitter of the internal photovoltaic cell, optionally wherein the substrate is an n-type substrate, and further optionally wherein the substrate is an Indium Phosphide substrate.

B18. The multilayer stack of paragraph B17, wherein the internal photovoltaic cell further includes a base, optionally wherein the base is a base layer, optionally wherein the base layer is an epitaxial, or epitaxially grown, base layer, optionally wherein the base is located between and electrically separates the substrate from the sacrificial anode portion, optionally wherein the base is a p-type base, and further optionally wherein the base is formed from Indium Phosphide.

B19. The multilayer stack of any of paragraphs B1-B15, wherein the internal photovoltaic cell is at least one of operatively attached to the substrate, formed on a surface of the substrate, and epitaxially grown from a surface of the substrate.

B20. The multilayer stack of paragraph B19, wherein the internal photovoltaic cell extends between and electrically separates the substrate from the sacrificial anode portion, optionally wherein the substrate is an optically transparent substrate that is configured to permit electromagnetic radiation to pass therethrough and be incident upon the internal photovoltaic cell, optionally wherein the substrate is an n-type substrate, and further optionally wherein the substrate is an Indium Phosphide substrate.

B21. The multilayer stack of any of paragraphs B19-B20, wherein the internal photovoltaic cell includes a base and an emitter, and further wherein the emitter extends between and electrically separates the base from the substrate, optionally wherein the base is a p-type base, optionally wherein the base is one of an Indium Phosphide base, an Indium Gallium Arsenide Phosphide base, an Aluminum Indium Arsenide base, an Aluminum Indium Gallium Arsenide base, a Gallium Arsenide Antimonide base, and/or an Aluminum Gallium Arsenide Antimonide base, optionally wherein the emitter is an n-type emitter, and further optionally wherein the emitter is an Indium Phosphide emitter, an Indium Gallium Arsenide Phosphide emitter, an Aluminum Indium Arsenide emitter, an Aluminum Indium Gallium Arsenide emitter, a Gallium Arsenide Antimonide emitter, and/or an Aluminum Gallium Arsenide Antimonide emitter.

B22. The multilayer stack of any of paragraphs B19-B21, wherein the internal photovoltaic cell further includes a back surface field (BSF) layer, optionally wherein the BSF layer extends between and electrically separates a remainder of the internal photovoltaic cell from the sacrificial anode portion, optionally wherein the BSF layer is a p-type BSF layer, and further optionally wherein the BSF layer is an Indium Phosphide BSF layer.

B23. The multilayer stack of any of paragraphs B1-B22, wherein the cathode portion includes at least one of an electrically conductive material and a metallic material.

B24. The multilayer stack of any of paragraphs B1-B23, wherein the cathode portion includes at least one of a cathode layer, a cathode film, an electrically conductive cathode layer, an electrically conductive cathode film, an electroplated cathode layer, a deposited layer, a continuous cathode layer, and a discontinuous cathode layer.

B25. The multilayer stack of any of paragraphs B1-B24, wherein the cathode portion is in direct engagement with at least one of the substrate and the internal photovoltaic cell.

B26. The multilayer stack of any of paragraphs B1-B25, wherein the electronic assembly is an epitaxial, or epitaxially grown, electronic assembly.

B27. The multilayer stack of any of paragraphs B1-B26, wherein the electronic assembly includes at least one of a device layer, a semiconductor device, a III-V semiconductor device, a photovoltaic cell, an inverted photovoltaic cell, and an inverted metamorphic solar cell.

B28. The multilayer stack of any of paragraphs B26-B27, wherein the substrate includes a plurality of electronic assemblies.

B29. The multilayer stack of paragraph B28, wherein the plurality of electronic assemblies includes at least one of a plurality of photovoltaic cells, a plurality of inverted photovoltaic cells, and a plurality of inverted metamorphic solar cells.

B30. The multilayer stack of any of paragraphs B26-B29, wherein the electronic assembly includes a planar electronic assembly, optionally a continuous planar electronic assembly, and further optionally a discontinuous planar electronic assembly.

C1. An electrochemical cell, comprising:

an electrically conductive fluid; and the multilayer stack of any of paragraphs B1-B30, wherein the multilayer stack is located within the electrically conductive fluid.

C2. The electrochemical cell of paragraph C1, wherein the electrically conductive fluid includes at least one of a liquid solution, an electrolyte solution, a salt solution, and a dilute salt solution.

C3. The electrochemical cell of any of paragraphs C1-C2, wherein the electrically conductive fluid includes a solute dissolved in a solvent.

C4. The electrochemical cell of paragraph C3, wherein a concentration of the solute is at least one of:

(i) at least 0.0001 molar (M), at least 0.0025 M, at least 0.005 M, at least 0.0075 M, at least 0.01 M, at least 0.02 M, at least 0.03 M, at least 0.04 M, at least 0.05 M, at least 0.06 M, at least 0.08 M, at least 0.1 M, at least 0.25 M, or at least 0.5 M; and (ii) less than 1 M, less than 0.75 M, less than 0.5 M, less than 0.25 M, less than 0.1 M, less than 0.075 M, less than 0.05 M, less than 0.025 M, less than 0.01 M, less than 0.009 M, less than 0.008 M, less than 0.007 M, less than 0.006 M, less than 0.005 M, less than 0.004 M, less than 0.003 M, less than 0.002 M, or less than 0.001 M.

C5. The electrochemical cell of any of paragraphs C3-C4, wherein the solute includes at least one of a salt, sodium iodide, and sodium chloride.

C6. The electrochemical cell of any of paragraphs C3-C5, wherein the solvent includes at least one of a liquid and water.

C7. The electrochemical cell of any of paragraphs C1-C6 in combination with a source of electromagnetic radiation, wherein the source of electromagnetic radiation is oriented to direct the electromagnetic radiation onto the internal photovoltaic cell, wherein at least one of a wavelength of the electromagnetic radiation and an intensity of the electromagnetic radiation is selected such that the internal photovoltaic cell generates a potential difference between the cathode portion and the sacrificial anode portion, wherein the potential difference produces dissolution of the sacrificial anode portion within the electrically conductive fluid, and further wherein a portion of the sacrificial anode portion is dissolved within the electrically conductive fluid.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. An electrochemical cell, comprising:

an electrically conductive fluid;

a multilayer stack of electronic components that includes an internal photovoltaic cell, a sacrificial anode portion, a cathode portion, and an electronic assembly, wherein the sacrificial anode portion extends between the electronic assembly and the substrate and operatively attaches the electronic assembly to the substrate, wherein the sacrificial anode portion extends between and electrically separates the electronic assembly from the internal photovoltaic cell, wherein the internal photovoltaic cell extends between and electrically separates the sacrificial anode portion from the cathode portion, wherein the multilayer stack is located within the electrically conductive fluid, and further wherein the electrically conductive fluid includes at least one of a liquid solution, an electrolyte solution, a salt solution, and a dilute salt solution; and a source of electromagnetic radiation, wherein the source of electromagnetic radiation is oriented to direct the electromagnetic radiation onto the internal photovoltaic cell, wherein at least one of a wavelength of the electromagnetic radiation and an intensity of the electromagnetic radiation is selected such that the internal photovoltaic cell generates a potential difference between the cathode portion and the sacrificial anode portion, wherein the potential difference produces dissolution of the sacrificial anode portion within the electrically conductive fluid, and further wherein a portion of the sacrificial anode portion is dissolved within the electrically conductive fluid.

2. A method of separating an electronic assembly from a multilayer stack of electronic components that includes the electronic assembly, a substrate, a cathode portion, and a sacrificial anode portion that is located between the electronic assembly and the substrate and that operatively attaches the electronic assembly to the substrate, wherein the multilayer stack is located within an electrically conductive fluid and forms an electrochemical cell, the method comprising:

generating a potential difference between the cathode portion and the sacrificial anode portion such that the cathode portion forms a cathode of the electrochemical cell and the sacrificial anode portion forms an anode of the electrochemical cell; and electrochemically oxidizing the sacrificial anode portion to dissolve the sacrificial anode portion within the electrically conductive fluid and separate the electronic assembly from the substrate.

3. The method of claim 2, wherein the multilayer stack includes an internal power source that is located between and in electrical and mechanical communication with the cathode portion and the sacrificial anode portion, wherein the sacrificial anode portion is located between the internal power source and the electronic assembly, and further wherein the generating includes generating the potential difference with the internal power source.

4. The method of claim 3, wherein the internal power source includes an internal photovoltaic cell, and further wherein the method includes:

directing electromagnetic radiation onto the internal photovoltaic cell to initiate the generating.

5. The method of claim 2, further comprising:

establishing a first electrical connection between the cathode portion and a negative terminal of an external power source; and establishing a second electrical connection between the sacrificial anode portion and a positive terminal of the external power source, wherein the generating includes generating the potential difference with the external power source.

6. The method of claim 2, wherein the multilayer stack is a first multilayer stack, wherein the electronic assembly is a first electronic assembly of the first multilayer stack, wherein the sacrificial anode portion is a first sacrificial anode portion of the first multilayer stack, and further wherein, subsequent to the electrochemically oxidizing, the method further comprises:

forming a second multilayer stack that includes a second electronic assembly, the substrate, and a second sacrificial anode portion that is located between the second electronic assembly and the substrate and that operatively attaches the second electronic assembly to the substrate.

7. The method of claim 6, wherein the method further comprises:

repeating at least the generating and the electrochemically oxidizing to separate the second electronic assembly from the substrate.

8. The method of claim 2, wherein the method further includes selecting a chemical composition of at least one of the cathode portion, the anode portion, and the electrically conductive fluid, wherein the selecting the chemical composition is based, at least in part, on a desired magnitude of the potential difference.

9. The method of claim 8, wherein the multilayer stack includes an internal photovoltaic cell that is in electrical communication with the cathode portion and the sacrificial anode portion, wherein the internal photovoltaic cell defines an operating voltage, and further wherein the desired magnitude of the potential difference is based on the operating voltage of the internal photovoltaic cell.

10. A multilayer stack of electronic components, comprising:

a substrate;

an internal photovoltaic cell;

a sacrificial anode portion;

a cathode portion; and an electronic assembly;

wherein:

(i) the sacrificial anode portion extends between the electronic assembly and the substrate and operatively attaches the electronic assembly to the substrate;

(ii) the sacrificial anode portion extends between and electrically separates the electronic assembly from the internal photovoltaic cell; and (iii) the internal photovoltaic cell extends between and electrically separates the sacrificial anode portion from the cathode portion.

11. The multilayer stack of claim 10, wherein the substrate includes at least one of a semiconductor material, a semiconductor wafer, Silicon, Germanium, a III-V semiconductor material, a II-VI semiconductor material, Cadmium Indium Gallium Selenide, Indium Phosphide, and Gallium Arsenide.

12. The multilayer stack of claim 10, wherein the sacrificial anode portion is an epitaxially grown sacrificial anode portion, wherein the internal photovoltaic cell is an epitaxially grown internal photovoltaic cell, and further wherein the electronic assembly is an epitaxially grown electronic assembly.

13. The multilayer stack of claim 10, wherein the internal photovoltaic cell is configured to receive electromagnetic radiation and to generate a potential difference between the sacrificial anode portion and the cathode portion when the electromagnetic radiation is incident upon a side of the substrate that is opposed to the sacrificial anode portion.

14. The multilayer stack of claim 10, wherein the substrate forms an emitter of the internal photovoltaic cell, wherein the internal photovoltaic cell further includes a base, and further wherein the base is located between and electrically separates the substrate from the sacrificial anode portion.

15. The multilayer stack of claim 10, wherein the internal photovoltaic cell is at least one of operatively attached to the substrate, formed on a surface of the substrate, and epitaxially grown from the surface of the substrate.

16. The multilayer stack of claim 15, wherein the internal photovoltaic cell extends between and electrically separates the substrate from the sacrificial anode portion, and further wherein the substrate is an optically transparent substrate that is configured to permit electromagnetic radiation to pass therethrough and be incident upon the internal photovoltaic cell.

17. The multilayer stack of claim 15, wherein the internal photovoltaic cell includes a base and an emitter, and further wherein the emitter extends between and electrically separates the base from the substrate.

18. The multilayer stack of claim 15, wherein the internal photovoltaic cell further includes a back surface field (BSF) layer, wherein the BSF layer extends between and electrically separates a remainder of the internal photovoltaic cell from the sacrificial anode portion.

19. An electrochemical cell, comprising:

an electrically conductive fluid; and the multilayer stack of claim 10, wherein the multilayer stack is located within the electrically conductive fluid.

20. The electrochemical cell of claim 19 in combination with a source of electromagnetic radiation, wherein the source of electromagnetic radiation is oriented to direct the electromagnetic radiation onto the internal photovoltaic cell, wherein at least one of a wavelength of the electromagnetic radiation and an intensity of the electromagnetic radiation is selected such that the internal photovoltaic cell generates a potential difference between the cathode portion and the sacrificial anode portion, wherein the potential difference produces dissolution of the sacrificial anode portion within the electrically conductive fluid, and further wherein a portion of the sacrificial anode portion is dissolved within the electrically conductive fluid.

* * * * *